US010982488B2

(12) United States Patent
Chen et al.

(10) Patent No.: US 10,982,488 B2
(45) Date of Patent: Apr. 20, 2021

(54) DUAL-TORSION-SPRING CORD ROLLING DEVICE FOR WINDOW BLIND WITHOUT EXPOSED PULL CORD

(71) Applicant: SHEEN WORLD TECHNOLOGY CORPORATION, Taichung (TW)

(72) Inventors: Hung-Hao Chen, Taichung (TW); Ming-Che Tsai, Taichung (TW)

(73) Assignee: SHEEN WORLD TECHNOLOGY CORPORATION, Taichung (TW)

( * ) Notice: Subject to any disclaimer, the term of this patent is extended or adjusted under 35 U.S.C. 154(b) by 246 days.

(21) Appl. No.: 16/198,342

(22) Filed: Nov. 21, 2018

(65) Prior Publication Data

US 2019/0162019 A1 May 30, 2019

(30) Foreign Application Priority Data

Nov. 24, 2017 (TW) ..... 106140972

(51) Int. Cl.
*E06B 9/322* (2006.01)
*B65H 75/48* (2006.01)

(52) U.S. Cl.
CPC ..... *E06B 9/322* (2013.01); *B65H 75/486* (2013.01); *E06B 2009/3222* (2013.01)

(58) Field of Classification Search
CPC .. E06B 9/322; E06B 2009/3222; E06B 9/323; E06B 9/30; E06B 9/325; E06B 2009/3225; E06B 2009/2627; B65H 75/486; B65H 75/14; F03G 1/00; F03G 1/02; F03G 1/06
See application file for complete search history.

(56) References Cited

U.S. PATENT DOCUMENTS

| | | | | |
|---|---|---|---|---|
| 9,988,838 | B2 * | 6/2018 | Chen | E06B 9/322 |
| 10,711,517 | B2 * | 7/2020 | Chen | E06B 9/322 |
| 2005/0072635 | A1 * | 4/2005 | Toti | E06B 9/322 185/10 |
| 2016/0208549 | A1 * | 7/2016 | Chen | E06B 9/322 |
| 2017/0067288 | A1 * | 3/2017 | Nien | E06B 9/322 |
| 2017/0107075 | A1 * | 4/2017 | Hung | E06B 9/32 |
| 2018/0313143 | A1 * | 11/2018 | Chang | E06B 9/322 |
| 2019/0063147 | A1 * | 2/2019 | Cheng | E06B 9/322 |
| 2019/0301238 | A1 * | 10/2019 | Chang | E06B 9/323 |

* cited by examiner

*Primary Examiner* — Daniel P Cahn
*Assistant Examiner* — Jeremy C Ramsey
(74) *Attorney, Agent, or Firm* — Browdy and Neimark, PLLC

(57) ABSTRACT

A dual-torsion-spring cord rolling device includes driving and transmission units. The driving unit has first and second torsion spring gears engaged with each other, a first torsion spring connecting the first and second torsion spring gears, a wheel adjacent to the first torsion spring gear, and a second torsion spring connecting the second torsion spring gear and the wheel. The transmission unit has first and second transmission gears rotatable synchronously by the driving of the second torsion spring gear, and two lift transmission cords attached to the first and second transmission gears respectively.

6 Claims, 5 Drawing Sheets

DUAL-TORSION-SPRING CORD ROLLING DEVICE FOR WINDOW BLIND WITHOUT EXPOSED PULL CORD

BACKGROUND OF THE INVENTION

1. Field of the Invention

The present invention relates to non-pull cord window blinds, and more particularly, to a dual-torsion-spring cord rolling device for the non-pull cord window blinds.

2. Description of the Related Art

As to the non-pull cord window blinds, the lift transmission cords are rolled up by the automatic cord rolling device disposed in the top beam. Owing that the lift transmission cords are connected to the bottom beam, the bottom beam is gradually moved up relative to the top beam during the process that the lift transmission cords are rolled up, so that the slats of the window blind are piled and raised by the upwardly moving bottom beam.

The aforesaid automatic cord rolling device is workable for normal-sized window blind. However, for the large-sized window blind, the pulling force provided by the aforesaid automatic cord rolling device may be too small to move up the bottom beam successfully. At present, the method to solve the aforesaid problem is to use two or more automatic cord rolling devices, but the increasement of the number of components certainly increases the manufacturing cost and the structural complication.

SUMMARY OF THE INVENTION

It is a primary objective of the present invention to provide a dual-torsion-spring cord rolling device for non-pull cord window blind, which can be workable along for the large-sized window blind without additional cord rolling device, thereby lowering manufacturing cost and simplifying the overall structure.

To attain the above objective, the present invention provides a dual-torsion-spring cord rolling device which includes a base, a driving unit, and a transmission unit. The driving unit has a first torsion spring gear, a second torsion spring gear, a first torsion spring, a wheel, and a second torsion spring. The first torsion spring gear is rotatably disposed in the base. The second torsion spring gear is rotatably disposed in the base and engaged with the first torsion spring gear. The first torsion spring connects the first and second torsion spring gears. The wheel is disposed in the base in a way that the wheel is rotatable freely and located adjacent to the first torsion spring gear. The second torsion spring connects the second torsion spring gear and the wheel. The transmission unit has a first transmission gear, a second transmission gear, and two lift transmission cords. The first and second transmission gears are disposed in the base in a way that the first and second transmission gears are rotatable synchronously and at least one of the first and second transmission gears is engaged with the second torsion spring gear. An end of one of the two lift transmission cords is attached to the first transmission gear, and an end of the other lift transmission cord is attached to the second transmission gear.

When the two lift transmission cords are pulled out at the same time, the first and second transmission gears rotate in opposite directions, and then the second transmission gear drives the second torsion spring gear to rotate. During the rotation of the second torsion spring gear, the second torsion spring gear drives the first torsion spring gear to rotate, and at the same time rolls up the first and second torsion springs, so that the resilient force of the first and second torsion springs is accumulated; at this time, the wheel is free to rotate. Once the resilient force of the first and second torsion springs is released, the second torsion spring gear will drive the second transmission gear to rotate reversely, and the second transmission gear will drive the first transmission gear to rotate reversely, so that the first and second transmission gears will roll up the associated lift transmission cords respectively; at this time, the wheel is free to rotate.

According to the above illustration, the cooperation of the first and second torsion springs makes the dual-torsion-spring cord rolling device of the present invention have enough rolling force to work along for large-sized window blind, so the large-sized window blind doesn't need the additional cord rolling device, thereby lowering manufacturing cost and simplifying the overall structure.

DETAILED DESCRIPTION OF THE INVENTION

Figure 1:
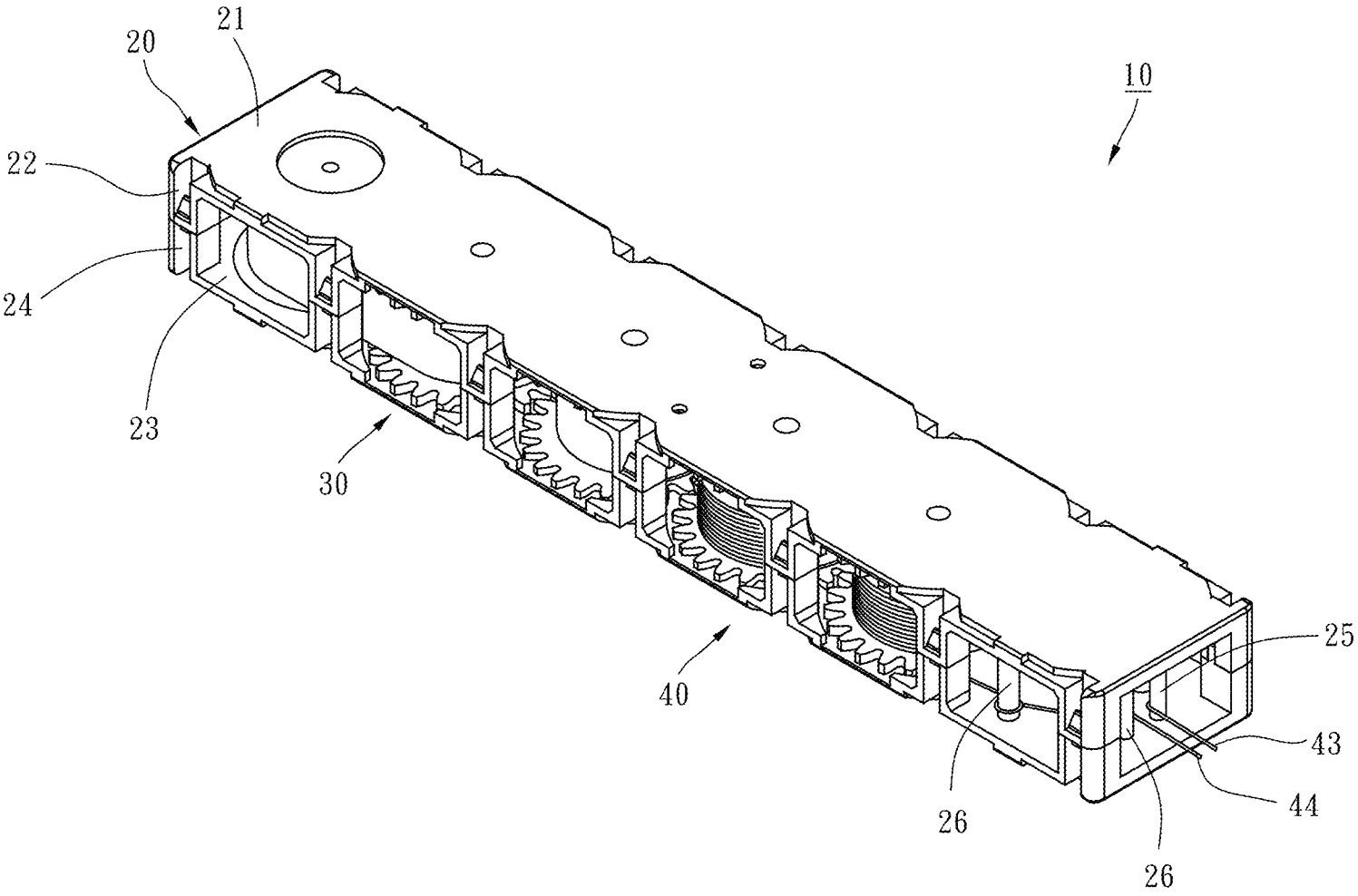
FIG. 1 is an assembled perspective view of a dual-torsion-spring cord rolling device according to a first embodiment of the present invention.
Figure 2:
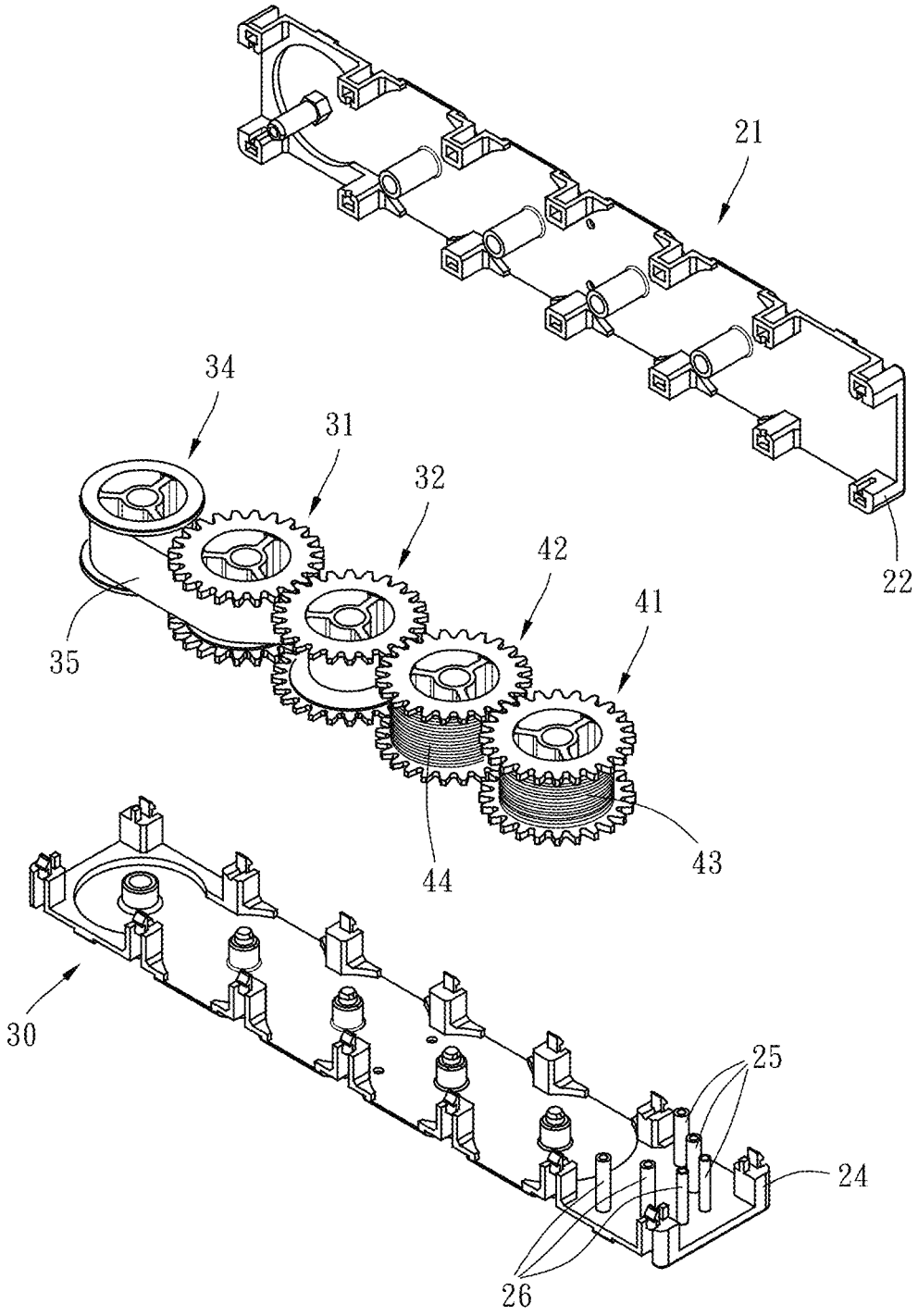
FIG. 2 is an exploded perspective view of the dual-torsion-spring cord rolling device according to the first embodiment of the present invention.

Referring to FIGS. 1-2, a dual-torsion-spring cord rolling device 10 according to a first embodiment of the present invention includes a base 20, a driving unit 30, and a transmission unit 40.

The base 20 is fixedly mounted on a top beam (not shown) and has a top plate 21 and a bottom plate 23. The top plate 21 is provided on the bottom surface thereof with a plurality of upper peripheral pillars 22, The bottom plate 23 is provided on the top surface thereof with a plurality of lower peripheral pillars 24, The top plate 21 and the bottom plate 23 are combined in a way that the upper and lower peripheral pillars 22 and 24 are engaged with each other. Besides, the base 20 is provided on an end thereof with a plurality of first and second guiding rods 25 and 26, which are positioned symmetrically. Two ends of each of the first and second guiding rods 25 and 26 are connected with the top plate 21 and the bottom plate 23 respectively.

Figure 3:
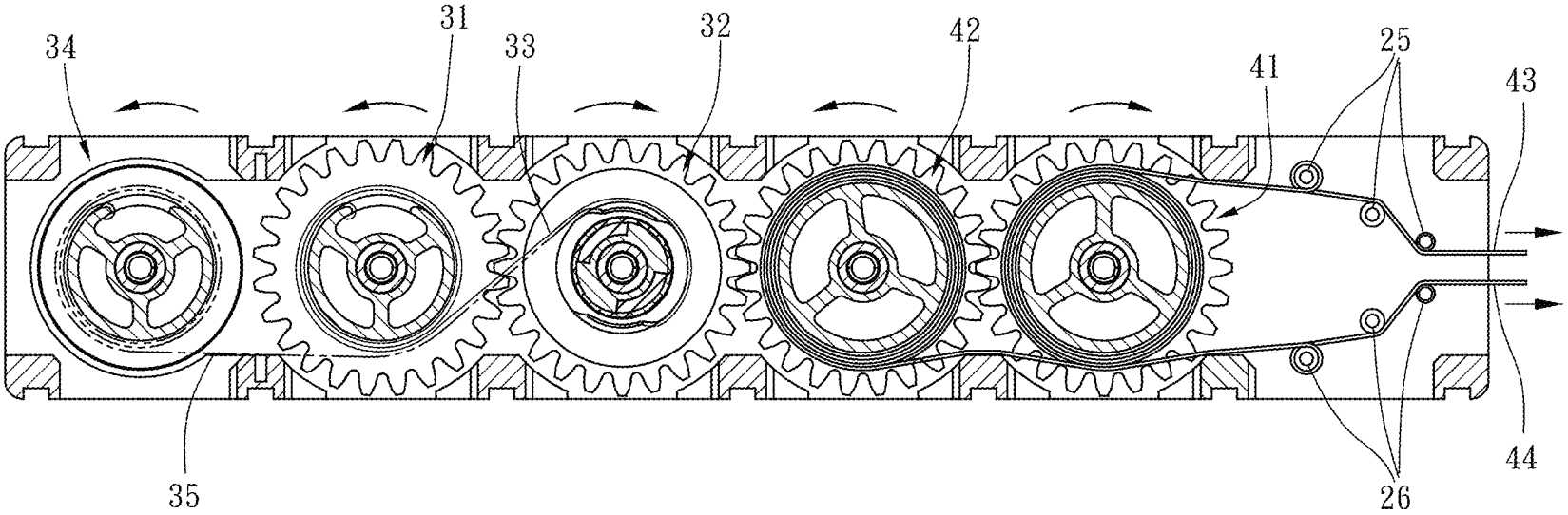
FIG. 3 is a cross-sectional view of the dual-torsion-spring cord rolling device according to the first embodiment of the present invention, primarily showing the condition that lift transmission cords are pulled out.

Referring to FIGS. 2-3, the driving unit 30 has a first torsion spring gear 31, a second torsion spring gear 32, a first torsion spring 33, a wheel 34, and a second torsion spring 35. The first and second torsion spring gears 31 and 32 are rotatably disposed in the base 20 and engaged with each other, so that the first and second torsion spring gears 31 and 32 are rotatable synchronously. The first torsion spring 33 connects the first and second torsion spring gears 31 and 32. The wheel 34 is disposed in the base 20 in a way that the wheel 34 is rotatable freely and located adjacent to the first torsion spring gear 31. The second torsion spring 35 connects the second torsion spring gear 32 and the wheel 34. The position where an end of the second torsion spring 35 is fixed to the second torsion spring gear 32 and the position where an end of the first torsion spring 33 is fixed to the second torsion spring gear 33 are opposite to each other.

The transmission unit 40 has a first transmission gear 41, a second transmission gear 42, and two lift transmission cords 43 and 44. In this embodiment, the first and second transmission gears 41 and 42 are rotatably disposed in the base 20 in a way that the first and second transmission gears 41 and 42 and the first and second torsion spring gears 31 and 32 are linearly arranged and the first and second transmission gears 41 and 42 are engaged with each other. The second transmission gear 42 is further engaged with the second torsion spring gear 32, so that the first and second transmission gears 41 and 42 and the second torsion spring gear 32 are rotatable synchronously. The two lift transmission cords 43 and 44 are wound around the first and second guiding rods 25 and 26 of the base 20 respectively. An end of the two lift transmission cords 43 and 44 are attached to the first and second transmission gears 41 and 42 respectively. The other end of the two lift transmission cords 43 and 44 are both connected with a bottom beam (not shown).

When the bottom beam is pulled down to unfold the slats, the two lift transmission cords 43 and 44 are gradually pulled out from the first and second transmission gears 41 and 42 by the bottom beam, at the same time, making the first and second transmission gears 41 and 42 rotate in opposite directions by the engagement therebetween. In the view shown in FIG. 3, the first transmission gear 41 rotates clockwise, and the second transmission gear 42 rotates counterclockwise. Then, the second transmission gear 42 drives the second torsion spring gear 32 to rotate clockwise. During the rotation of the second torsion spring gear 32, the second torsion spring gear 32 drives the first torsion spring gear 31 to rotate counterclockwise, and at the same time rolls up the first and second torsion springs 33 and 35, so that the resilient force of the first and second torsion springs 33 and 35 is accumulated. At this time, the wheel 34 is driven by the second torsion spring 35 to rotate freely. Through the free rotation of the wheel 34, the rolled length of the second torsion spring 35, which is rolled up by the second torsion spring gear 32, is compensated and adjusted appropriately, so that the first and second torsion springs 33 and 35 can be smoothly wound around the second torsion spring gear 32 together.

Figure 4:
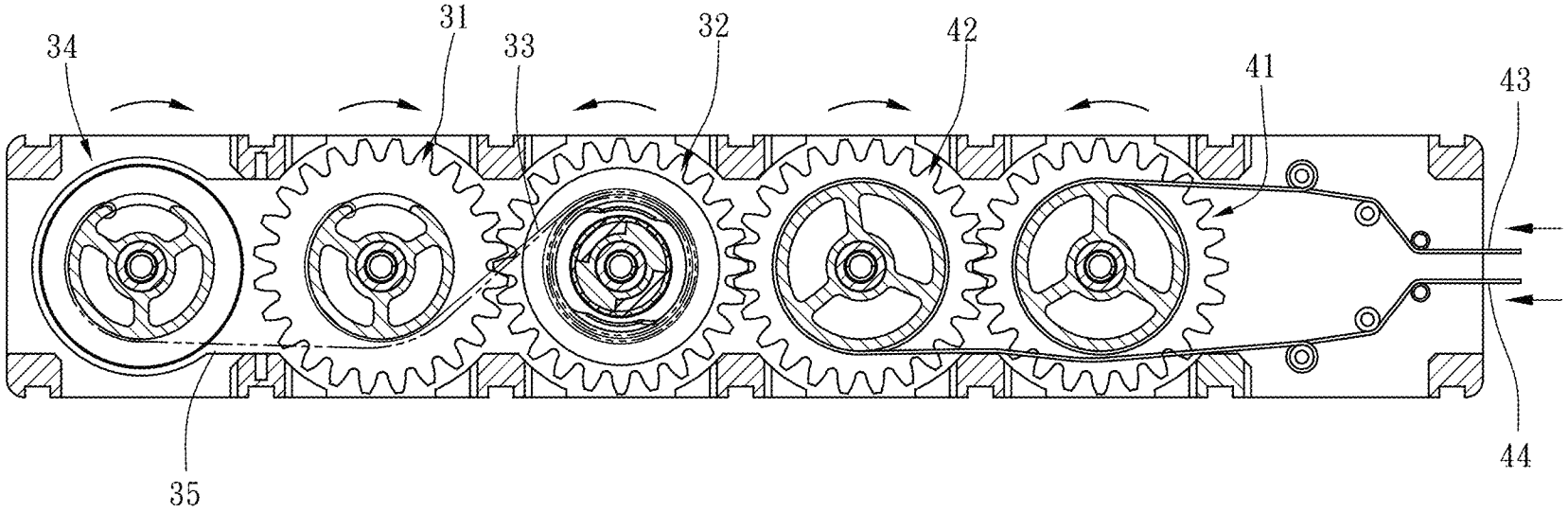
FIG. 4 is similar to FIG. 3, but primarily showing the condition that the lift transmission cords are rolled up.

In opposite, when the bottom beam is pushed up, the upward pushing force received by the bottom beam counteracts the weight of the bottom beam and all the slats, so that the resilient force of the first and second torsion springs 33 and 35 is released to drive the second torsion spring gear 32 to rotate. As shown in FIG. 4, during the rotation of the second torsion spring gear 32, the second torsion spring gear 32 drives the second transmission gear 42 to rotate, and the second transmission gear 42 further drives the first transmission gear 41 to rotate, so that the first and second transmission gears 41 and 42 roll up the associated lift transmission cords 43 and 44 respectively, causing the slats to be folded up stably.

When the bottom beam is not applied with external force, the first and second guiding rods 25 and 26 respectively provides the two lift transmission cords 43 and 44 appropriate resistance, enabling the slats to stop anytime at any height and not easily extended or fold up when the external force is relieved.

Figure 5:
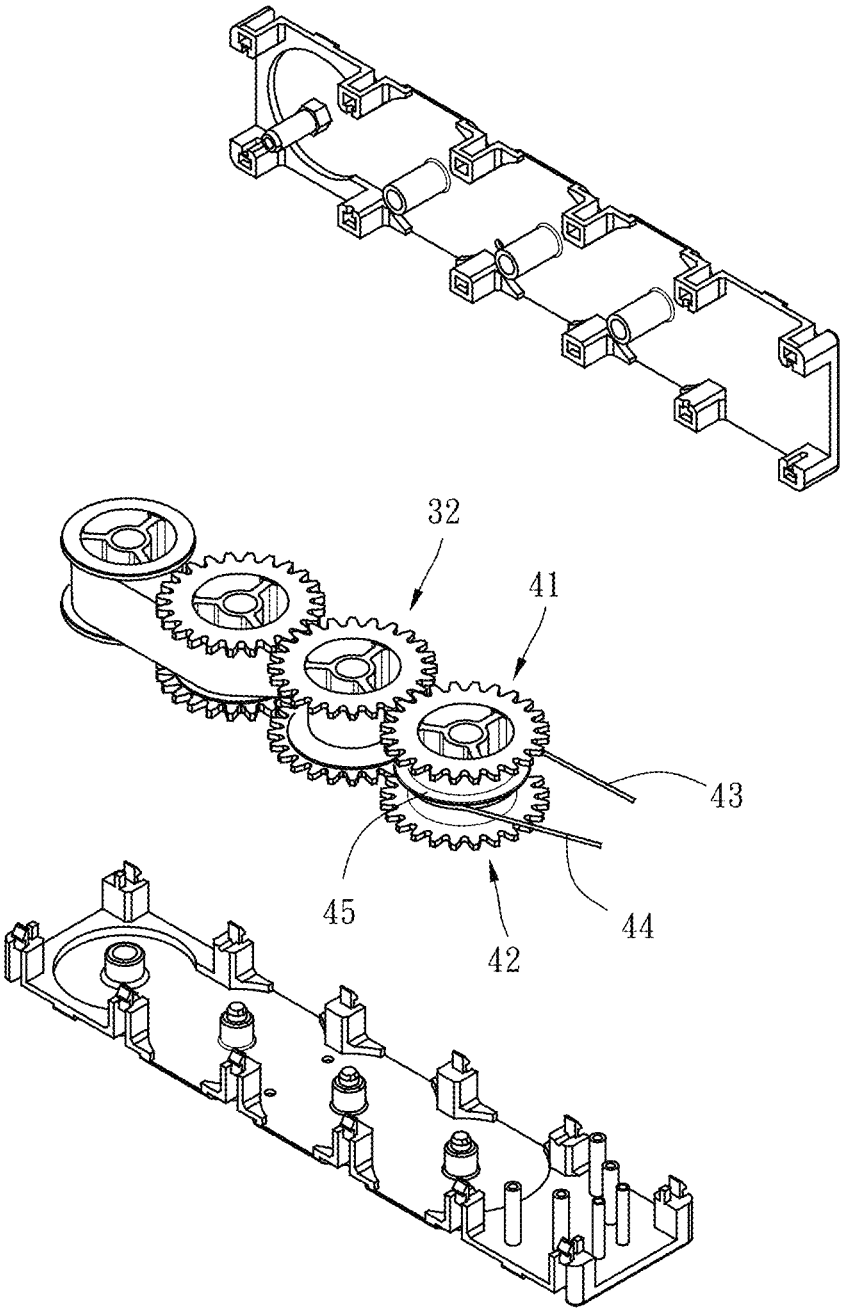
FIG. 5 is an exploded perspective view of a dual-torsion-spring cord rolling device according to a second embodiment of the present invention.

On the other hand, the first and second transmission gears 41 and 42 may be structurally modified in second embodiment. As shown in FIG. 5, the first and second transmission gears 41 and 42 may be alternatively connected coaxially to constitute a combined gear, and the combined gear engages with the second torsion spring gear 32, so that the first and second transmission gears 41 and 42 can be also driven by the second torsion spring gear 32 through the engagement therebetween. The two lift transmission cords 43 and 44 are also respectively attached to the first and second transmission gears 41 and 42 of the combined gear by an end thereof, and separated by a plate 45 disposed in a middle of the combined gear, thereby preventing from interference with each other.

In conclusion, through the cooperation of the first and second torsion springs 33 and 35, the dual-torsion-spring cord rolling device 10 of the invention has enough rolling force to work along for large-sized window blinds, so the large-size window blind doesn't need additional cord rolling device, thereby lowering manufacturing cost and simplifying the overall structure. Besides, the first and second torsion springs 33 and 35 may be alternatively designed in the same or different width or thickness, so that the resilient three thereof may be equal or unequal, providing multiple choices to the structural arrangement of window blind according to different practical demand and enhancing the structural design flexibility to better manipulate the resilient force generated by the dual-torsion-spring cord rolling device.

What is claimed is:

1. A dual-torsion-spring cord rolling device for a window blind without an exposed pull cord, the dual-torsion-spring cord rolling device comprising:

a base;

a driving unit having a first torsion spring gear, a second torsion spring gear, a first torsion spring, a wheel and a second torsion spring, the first torsion spring gear being rotatably disposed in the base, the second torsion spring gear being rotatably disposed in the base and engaged with the first torsion spring gear, the first torsion spring being connected to both of the first and second torsion spring gears, the wheel being disposed in the base in a way that the wheel is rotatable and located adjacent to the first torsion spring gear, the second torsion spring connecting the second torsion spring gear and the wheel; and a transmission unit having a first transmission gear, a second transmission gear and two lift transmission cords, the first and second transmission gears being disposed in the base in a way that the first and second transmission gears are rotatable synchronously and at least one of the first and second transmission gears is engaged with the second torsion spring gear, an end of a first of the two lift transmission cords being attached to the first transmission gear, an end of a second of the two lift transmission cords being attached to the second transmission gear.

2. The dual-torsion-spring cord rolling device as claimed in claim 1, wherein the first and second torsion springs are different in width.

3. The dual-torsion-spring cord rolling device as claimed in claim 1, wherein the base is provided on an end of the base with a plurality of first guiding rods and a plurality of second guiding rods; wherein the first of the two lift transmission cords is wound around the first guiding rods; and wherein the second of the two lift transmission cords is wound around the second guiding rods.

4. The dual-torsion-spring cord rolling device as claimed in claim 1, wherein the first and second transmission gears and second torsion spring gear are arranged linearly; and wherein the second transmission gear is engaged with the second torsion spring gear and the first transmission gear and located between the second torsion spring gear and the first transmission gear.

5. The dual-torsion-spring cord rolling device as claimed in claim 1, wherein the first and second transmission gears are connected coaxially to constitute a combined gear, and the combined gear is engaged with the second torsion spring gear.

6. The dual-torsion-spring cord rolling device as claimed in claim 1, wherein the first and second torsion springs are different in thickness.

* * * * *